US006276941B1

(12) United States Patent
Wu

(10) Patent No.: US 6,276,941 B1
(45) Date of Patent: Aug. 21, 2001

(54) BOARD TO BOARD CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/511,651

(22) Filed: Feb. 22, 2000

(51) Int. Cl.[7] ..... H01R 12/22
(52) U.S. Cl. ..... 439/66; 439/515
(58) Field of Search ..... 439/66, 74, 630, 439/515, 862

(56) References Cited

U.S. PATENT DOCUMENTS 4,362,353 * 12/1982 Cobaugh et al. ..... 439/515
4,647,124 * 3/1987 Kandybowski ..... 439/515
5,879,169 * 3/1999 Wu ..... 439/66
5,980,323 * 11/1999 Bricaud et al. ..... 439/630
5,984,693 * 11/1999 McHugh et al. ..... 439/515
6,019,611 * 2/2000 McHugh et al. ..... 439/515
6,027,345 * 3/1999 McHugh et al. ..... 439/66

* cited by examiner

*Primary Examiner*—Gary F. Paumen
(74) *Attorney, Agent, or Firm*—Wei Te Chung

(57) ABSTRACT

A board to board electrical connector comprises an insulative housing defining a plurality of channels at both sides thereof and a plurality of conductive contacts received in the respective channels. Each contact comprises a resilient portion, an arm extending upward and outward from an upper end thereof and a mounting portion extending horizontally from a lower end thereof for mounting on a lower wall of the housing. The arm forms an engaging portion at an outer end thereof for contacting a pad on an upper board. A free arm then bends backward and downward from the engaging portion for supporting against the mounting portion when the contact is under compression. A soldering portion extends from the mounting portion for soldering to a lower PC board. Finally, a free end extends from the soldering portion and is retained in a respective pair of slits defined by the housing.

1 Claim, 4 Drawing Sheets

BOARD TO BOARD CONNECTOR

BACKGROUND OF THE INVENTION

The present invention relates to a board to board connector, and particularly to a board to board connector which provides a plurality of improved conductive contacts.

Board to board electrical connectors have been widely used and, referring to FIG. 4, a conventional board to board connector 5 comprises an insulative housing 10 defining a plurality of channels 102 (only two shown), and a plurality of conductive contacts 12 (only two shown) received in respective channels 102. Each contact 12 comprises an arced resilient portion 13 retained in a respective channel 102, an arm 14 extending upward from an upper end of the resilient portion 13, and a mounting portion 16 horizontally extending from a lower end of the resilient portion 13. The mounting portion 16 has barbs (not shown) fixedly engaging with the housing 10. A tail portion 17 is horizontally and outwardly extending from the mounting portion 16 and located below the mounting portion 16. The tail portion 17 is used for soldering to a respective pad on a lower PC board (not shown) by Surface Mounting Technology (SMT). The arm 14 forms an arced engaging portion 15 at its upper free end for contacting a respective pad on an upper PC board (not shown). When the conventional connector 5 connects the two PC boards, a downward pressing force on the engaging portion 15 is wholly exerted to the resilient portion 13, causing a great stress concentration at such place. Therefore, after a period of use, the resilient portion 13 becomes fatigue, resulting in an insufficient force for the engaging portion 15 to reliably electrically connect with the upper board. Furthermore, as the connector 5 lacks any structure which can effectively retained the tail portion 17, the tail portion 17 may leave its desired horizontal orientation, resulting in poor quality regarding soldering the tail portion to the lower PC board by SMT. Finally, the signal transmitting path from the engaging portion 15 to the solder tail 17 is relatively long, which is unfavorable in view of high frequency transmission since the resistance and inductance are proportional to the length of the signal travel path.

Hence, a board to board connector with improved conductive contacts is required to overcome the disadvantages of the prior art.

BRIEF SUMMARY OF THE INVENTION

A first object of the present invention is to provide a board to board electrical connector having a plurality of improved conductive contacts which can reduce stress concentration therein during use.

A second object of the present invention is to provide a board to board electrical connector having a plurality of improved conductive contacts which can reduce the length of travelling path of signal therethough.

A third object of the present invention is to provide a board to board connector having improved coplanarity regarding soldering portions of contacts of the connector so that the connector can be well soldered to a PC board by using surface mounting technology (SMT).

A board to board electrical connector of the present invention comprises an insulative housing defining a plurality of channels at both sides thereof and a plurality of conductive contacts received in the respective channels. Each channel is defined by an upper wall, a lower wall, a rib connecting the upper wall to the lower wall and two laterally-extending adjacent partitions defining a pair of slits in opposite inner faces thereof. Each contact comprises an arced resilient portion retained in an inner portion of each channel, an arm extending upward and outward from an upper end of the resilient portion and a mounting portion extending horizontally from a lower end of the resilient portion for mounting on the lower wall. The arm forms an engaging portion at an outer end thereof for contacting a pad on an upper board. A free arm then bends backward and downward from the engaging portion for supporting against the mounting portion when the contact is under compression. A soldering portion extends from the mounting portion and is retained by a lower portion of each channel for soldering to a lower PC board. Finally, a free end extends from an outer end of the soldering portion and is retained in a pair of slits of corresponding partitions.

Other objects, advantages and novel features of the invention will become more apparent from the following detailed description of the present embodiment when taken in conjunction with the accompanying drawings.

DETAILED DESCRIPTION OF THE INVENTION

Figure 1:
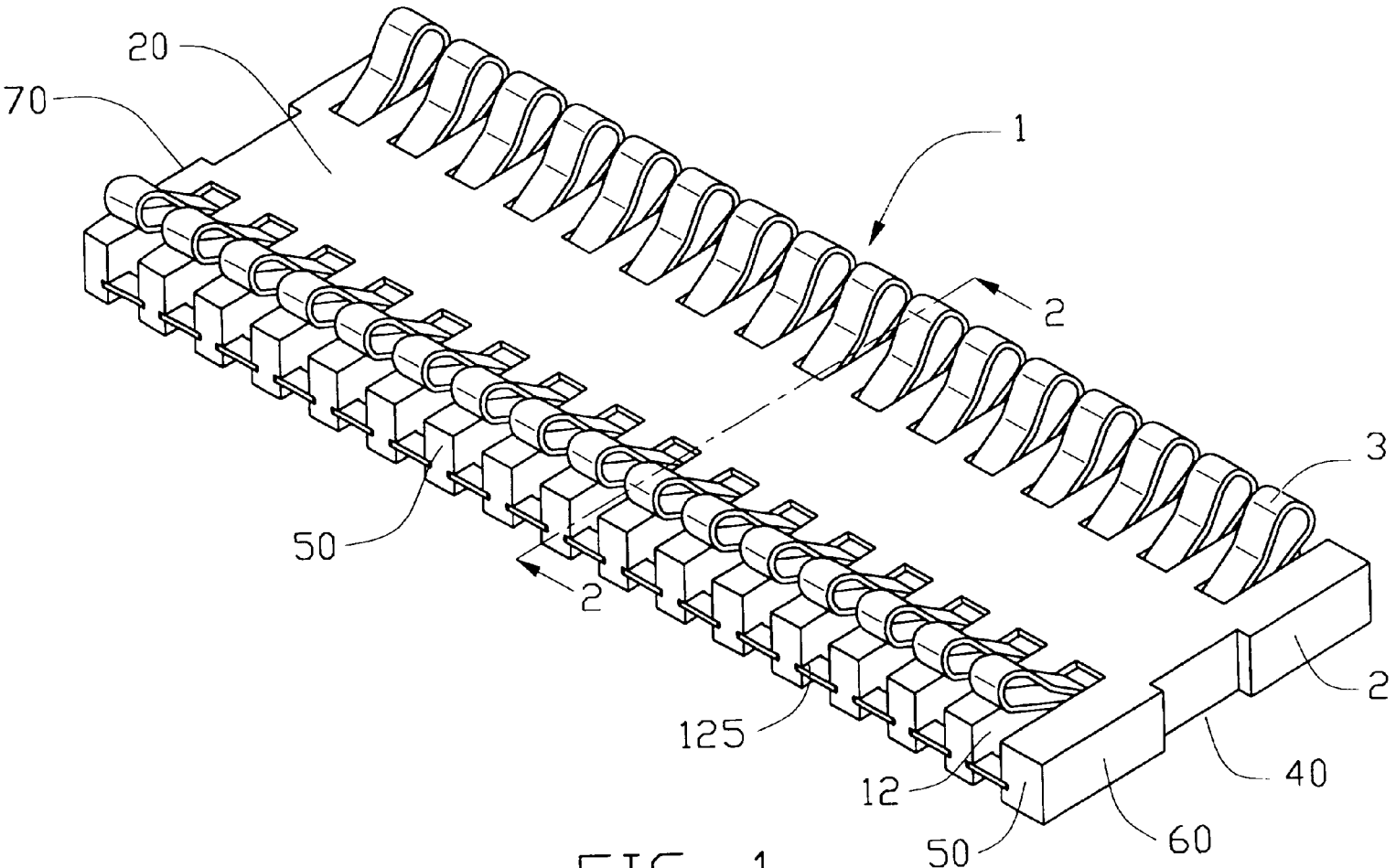
FIG. 1 is a front-left-top perspective view of a board to board electrical connector of the present invention.
Figure 3:
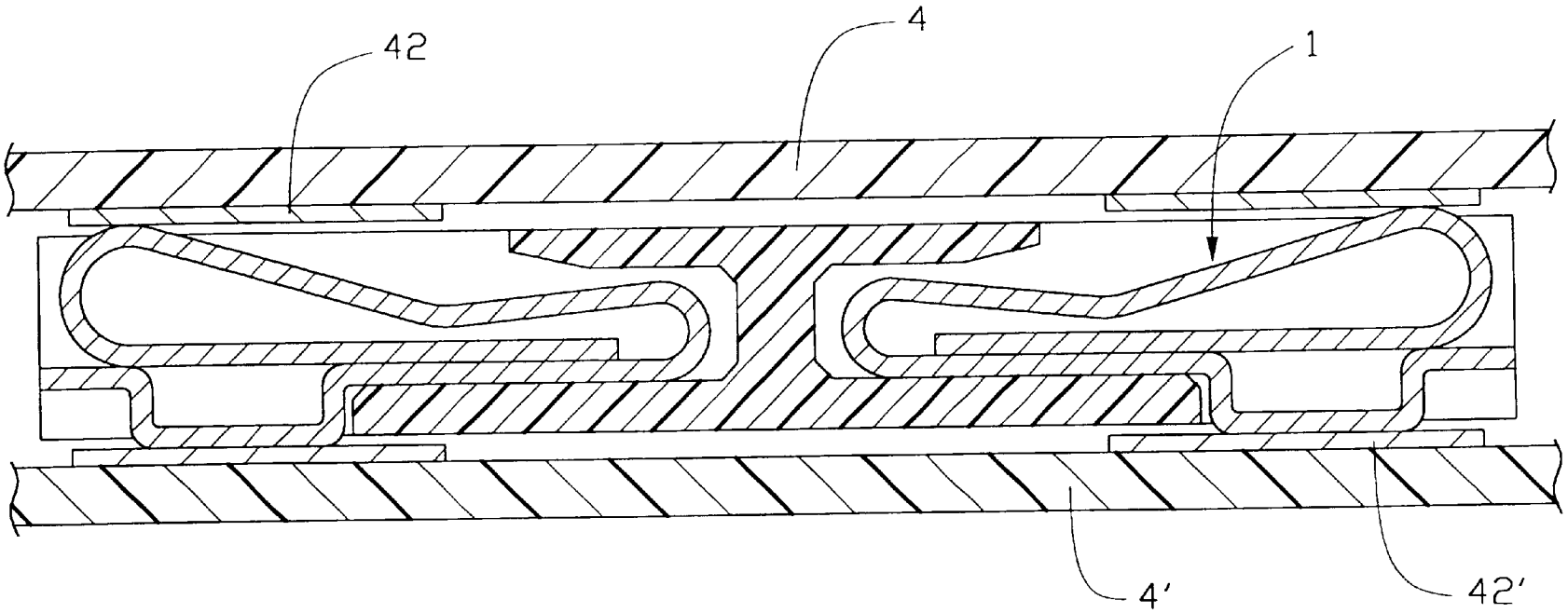
FIG. 3 is a cross-sectional view of the board to board connector of the present invention connected between an upper and lower PC board.
Figure 4:
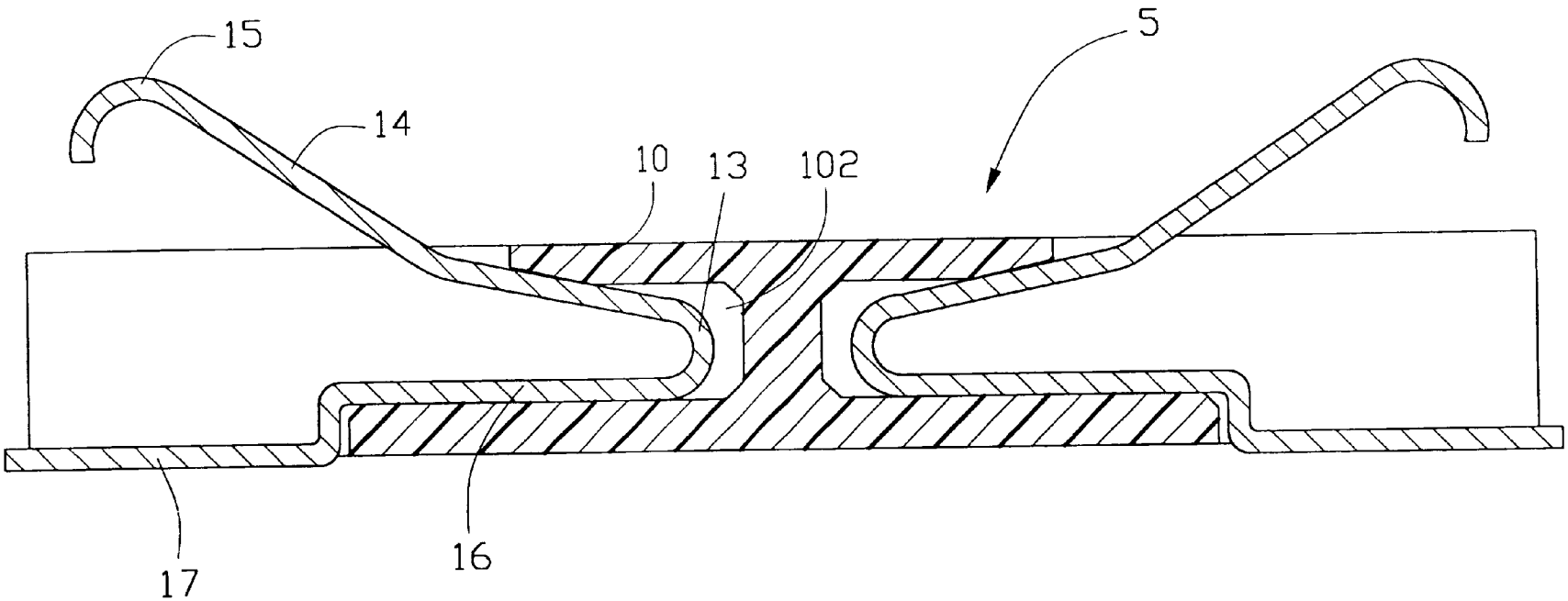
FIG. 4 (PRIOR ART)
FIG. 4 is a cross-sectional view of a prior art board to board connector.

Referring to FIGS. 1 and 3, a board to board electrical connector 1 of the present invention is used to provide electrical interconnection between an upper and lower PC board 4 and 4'. The connector 1 comprises an insulative housing 2 and a plurality of conductive contacts 3 received in the housing 2.

Figure 2:
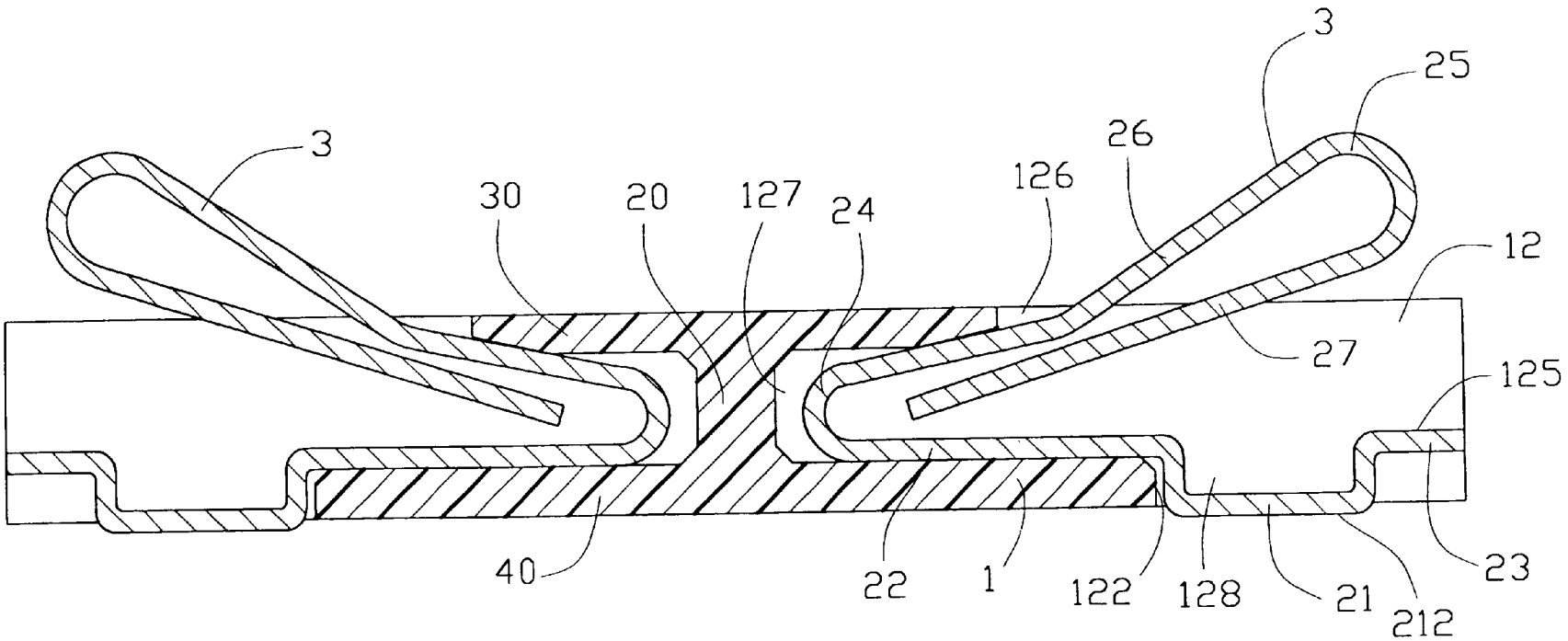
FIG. 2 is a cross-sectional view taken along line 2—2 of FIG. 1.

Referring to FIGS. 1 and 2, the insulative housing 2 is made of a suitable insulative material, such as a molded thermoplastic and formed as one unitary piece. The housing 2 defines a plurality of pairs of forwardly and rearwardly extending channels 12. The channels 12 of each pair each have a configuration which is symmetric to that of the other about a central rib 20 of the housing 2. Each channel 12 receives a conductive contacts 3 therein. The channels 12 each are defined by an upper wall 30, a lower wall 40 which connects the upper wall via the rib 20 and two neighboring ones of a plurality of partitions 50 extending forwards and rearwards from the central rib 20. The partitions 50 are located between two lateral edges 60, 70 of the housing 2. The four partitions 50 located adjacent to the lateral edges 60, 70 of the housing 2 each defines a slit 125 in its inner side face. The other partitions 50 each defines two slits 125 respectively located in its two opposite side faces. These slits 125 are all located at the same level. Since the channels 12 are symmetrical about the central rib 20, a detailed description is given only regarding one of the channels 12 rear of the rib 20 in connection with FIG. 2. The channel as shown in FIG. 2 has an upper portion 126 extending through and located rear of the upper wall 30, an inner portion 127 bounded by the upper and the lower walls 30, 40 and the central rib 20, and a lower portion 128 extending through and located rear of the lower wall 40 and below the slit 125.

Referring to FIGS. 1 through 3, each conductive contact 3 is curved in shape and comprises an arced resilient portion 24, an arm 26 extending upward and outward from an upper end thereof and a mounting portion 22 extending horizontally from a lower end thereof. The resilient portion 24 is retained in the inner portion 127 of each respective channel 12. The arm 26 further forms an arc-shaped engaging portion 25 at its outer end which provides the contact surface for establishing electrical contact with a respective contact pad 42 on the upper PC board 4. Then the contact 3 bends backward and downward from the engaging portion 25 and thus forms a linear free arm 27 located between the arm 26 and the mounting portion 22. The mounting portion 22 has barbs (not shown) fixedly engaging with the lower wall 40. A U-shaped soldering portion 21 depends downward from the mounting portion 22 and is retained in the lower portion 128 of each respective channel 12 for soldering to a respective pad 42' on the lower PC board 4'. Additionally, a free end 23 extends from an outer end of the soldering portion 21 for being latched in two corresponding slits 125 of two partitions 50.

In assembly, first referring to FIG. 2, each contact 3 is inserted in a respective channel 12 of the housing 1 with the soldering portion 21 extending slightly below a bottom surface of the housing 1. The resilient portion 24 is inserted into the inner portion 127 of the channel 12. The free arm 27 is partially received in the channel 12 and the free end 23 engages with the respective two slits 125. A lower surface 212 of each soldering portion 21 is soldered to the respective pad 42' on the lower PC board 4'. Referring to FIG. 3, the upper PC board 4 is then pressed against the contacts 3 from the top of the housing 2 by a manual force. Each of the pads 42 on the upper board 4 is placed in compression contact with the engaging portion 25 of a corresponding conductive contact 3. The compression force resiliently compresses the free arm 27 against the mounting portion 22 and the free end 23, thereby reducing the stress generated in the resilient portion 24 of each of the conductive contacts 3 to effectively protect the contacts 3 from fatigue. Furthermore, the free ends 23 of the contacts 2 being latched in the corresponding two slits 125 of the two partitions 50 of the housing 1 ensures coplanarity of the soldering portions 21 during soldering to the pads 42' of the lower PC board 4'. Finally, signal from the board 4 to the board 4' can be transmitted through the engaging portion 25, the free arm 27, the free end 23 and the soldering portion 21; thus, the length of travelling path of the signal can be reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A board-to-board connector for use with upper and lower printed circuit boards, comprising:

an insulative housing defining a plurality of channels therein and a base wall thereof, each of said channels being formed between adjacent partitions;

a plurality of contacts respectively retained in the corresponding channels, each of said contacts including:

a mounting portion supportably seated upon the base wall;

a soldering portion depending and downwardly offset from the mounting portion, said soldering portion engaged with the lower printed circuit board;

a free end portion depending and upwardly offset from the soldering portion, and received within two slits by two sides of the corresponding channel in which the contact is received;

a resilient portion obliquely extending upwardly and outwardly from the mounting portion opposite to the soldering portion; and a free arm extending downwardly and inwardly from the resilient portion; wherein said free arm is spaced from the mounting portion and the free end portion when said contact is not engaged with the upper printed circuit board, while said free arm is engaged with both the mounting portion and the free end portion when said contact is engaged with the upper printed circuit board;

wherein the mounting portion, the soldering portion and the free end portion all extend horizontally;

wherein said free arm extends horizontally.

* * * * *